US005417271A

United States Patent [19]

Fenley

[11] Patent Number: 5,417,271

[45] Date of Patent: May 23, 1995

[54] DECORATIVE WINDOW TREATMENT MOUNTING SYSTEM AND METHOD

[76] Inventor: Joel S. Fenley, 362 Starling, Commerce Township, Mich. 48382

[21] Appl. No.: 98,861

[22] Filed: Jul. 29, 1993

[51] Int. Cl.[6] ..... E06B 9/38

[52] U.S. Cl. ..... 160/38

[58] Field of Search ..... 160/38, 39, 19, 327, 160/392, 395, 405

[56] References Cited

U.S. PATENT DOCUMENTS

| | | | |
|---|---|---|---|
| 4,053,008 | 10/1977 | Baslow | 160/327 |
| 4,114,233 | 9/1978 | Hamilton | 160/38 X |
| 4,955,419 | 9/1990 | Morris | 160/38 |
| 5,219,013 | 6/1993 | Rozon | 160/38 |
| 5,232,039 | 8/1993 | Shapiro et al. | 160/38 X |

*Primary Examiner*—David M. Purol

*Attorney, Agent, or Firm*—Alex Rhodes

[57] ABSTRACT

A mounting system and method for mounting a decorative window treatment, such as a valance or lambrequin comprising a first complementary member having a resilient spline portion extending along the length of the member, a second complementary member which is adapted to interlock with the first member and the decorative window treatment, and an adhesive strip for attaching one of the complementary members to a headrail of the window treatment. The spline of the first complementary member has a pair of opposing spaced apart arcuate half portions separated by a gap and an adjoining channel portion for flexing the arcuate half portions towards each other during the interlocking of the first member with the second member and the window treatment.

12 Claims, 6 Drawing Sheets

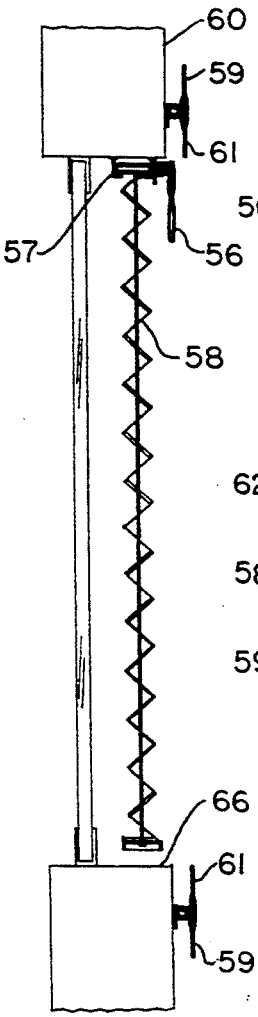
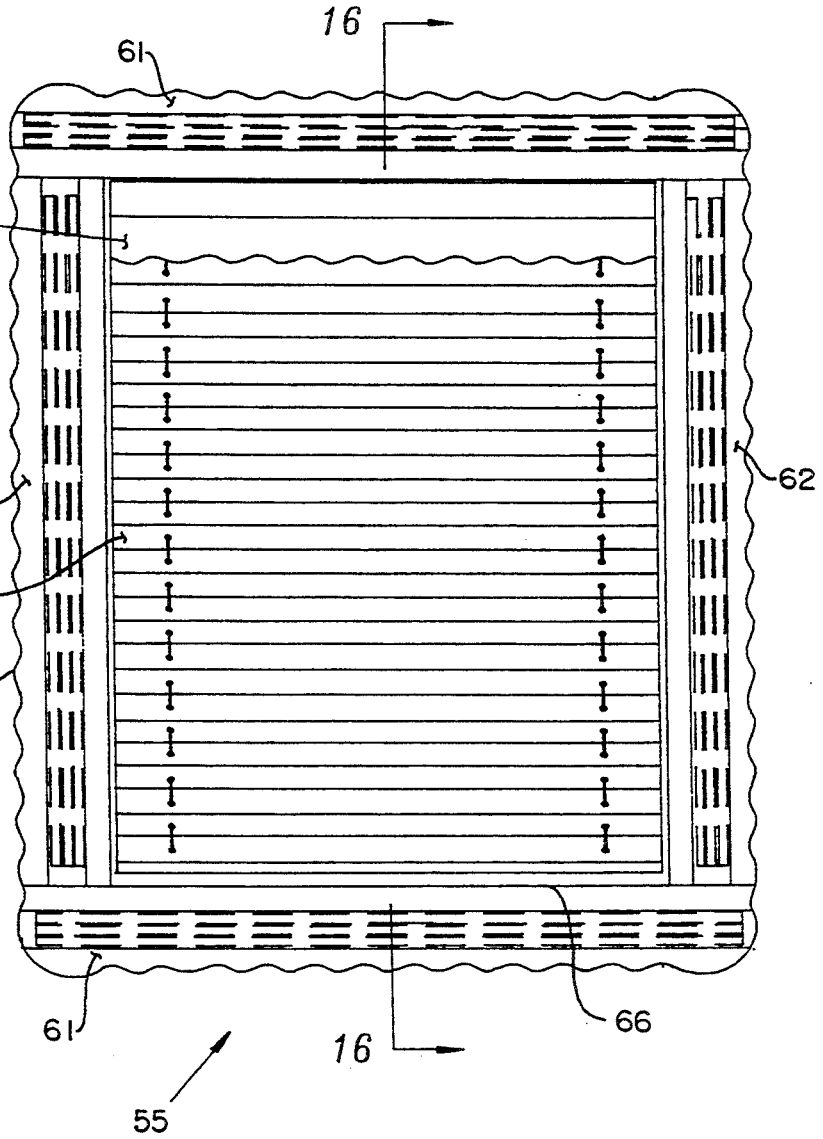
FIG. 16
FIG. 15

DECORATIVE WINDOW TREATMENT MOUNTING SYSTEM AND METHOD

FIELD OF THE INVENTION

This invention relates to decorative window treatments and more particularly to a system and method for mounting decorative window treatments such as valances and lambrequins to windows covered by blinds and shades.

BACKGROUND OF THE INVENTION

Horizontal blinds, vertical blinds and pleated shades are window coverings which roll up, pull up, or rotate for efficient and convenient light control. They are available in a variety of colors and styles to complement almost every decorative concept.

The blinds and pleated shades are popular because of their appearance, effectiveness and very little maintenance. They are mounted on the outside and in the recessed portions of window openings by engaging the ends of headrails to brackets attached to the sides of window openings.

At present, professional installers are generally used for mounting decorative window treatments, such as cornices, valances and lambrequins. The decorative window treatments are attached to interior walls with nails and screws. Under current practices, installations are expensive because they require special skills.

SUMMARY OF THE INVENTION

The present invention is an inexpensive, easy to use system and method for installing decorative window treatments, such as valances and lambrequins with window coverings, such as blinds and shades.

One benefit of the invention is that it reduces the time for mounting decorative window treatments. Another benefit is that it can be used with a variety of window treatments. Still yet another benefit is that it reduces the cost for installing window treatments. Still yet another benefit is that it can be used by an ordinary purchaser.

In the first aspect of the invention, a pair of resilient interlocking members and an adhesive means are provided for mounting a decorative window treatment to a window covering or window. In a second aspect of the invention, one of the interlocking members is formed from the same piece as the track of a window blind or a shade.

One of the interlocking members is a rod having a spline formed by a pair of spaced apart arcuate half portions separated by a gap and an adjoining channel portion. The other member is a bracket having a socket which is adapted for interlocking with a window treatment and the spline of the first member.

Further features and benefits of my invention, will be apparent from the ensuing detailed description taken in conjunction with the accompanying drawings. The best mode which is contemplated in practicing my invention is disclosed and the subject matter in which exclusive property rights are claimed is set forth in each of the numbered claims which are appended to the detailed description.

BRIEF DESCRIPTION OF THE DRAWINGS

FIG. 15 is a front view of a lambrequin mounted on a wall with a vertical blind with my invention.

FIG. 16 is a cross-sectional view taken on the line 16—16 in FIG. 15.

DETAILED DESCRIPTION OF THE PREFERRED EMBODIMENT

Figure 2:
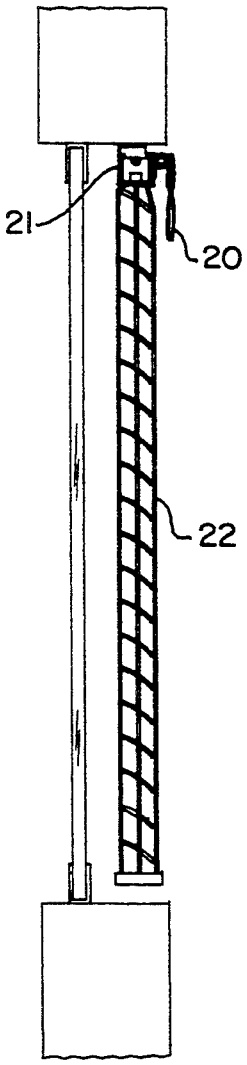
FIG. 2 is a cross-sectional view taken on the line 2—2 in FIG. 1.

Referring now to the drawings wherein like numerals designate like and corresponding parts throughout the several views, a mounting system for mounting decorative window treatments such as valances and lambrequins to blinds and shades is shown in FIGS. 1 through 4, inclusive, according to the invention.

Figure 3:
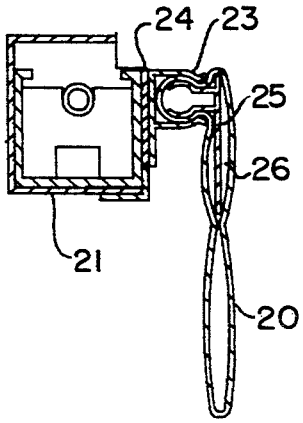
FIG. 3 is an enlarged fragmentary portion of FIG. 2.
Figure 4:
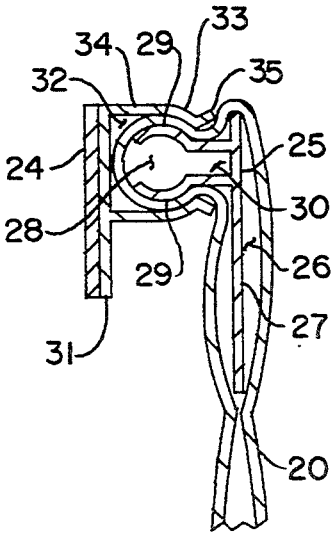
FIG. 4 is an enlarged fragmentary portion of FIG. 3

My invention can be understood by referring to FIG. 3 showing in cross-section a valance 20 joined with my invention to the headrail 21 of a pair of horizontal blinds 22. The valance 20 is mounted to the headrail 21 with a pair of extruded resilient plastic members 23, 25 which interlock with the valance 20 and an adhesive strip 24. One of the members 23, referred to herein as a bracket 23, is joined to the headrail 21 with the adhesive strip 24.

The top portion of the valance 20 is a pocket 26 through which the other elongated member 25, referred to herein as a rod 25, extends. The rod 25 is comprised of a thin blade portion 27 and an adjoining central spline portion 28 which extends along the length the blade portion 27. The spline 28 has an outer pair of spaced apart arcuate half portions 29 separated by a gap and an adjoining channel portion 30.

The channel portion 30 is a desirable feature because valances vary in thickness. It allows the arcuate half portions 29 separated by a gap of the spline 28 to flex in greater amount towards each other during the interlocking of the rod 25 with the bracket 23 and valance 20. It also allows the same rods 25 and brackets 23 to be used with valances of different thicknesses. The flexing of the arcuate half portions 29 separated by a gap reduces installation forces and prevents bracket failures due to excessive stress.

Figure 1:
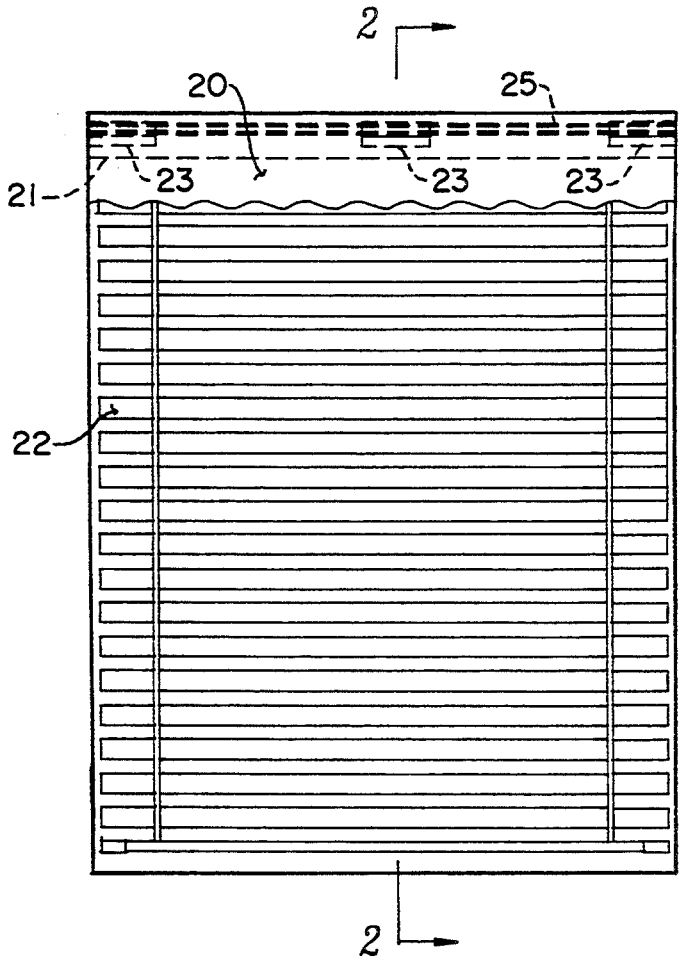
FIG. 1 is a front view of a valance mounted on the headrail of a horizontal blind with my invention.

The bracket 23 is comprised of a thin vertical blade portion 31 and an interlocking socket portion 32. The socket portion 32 which is sized and shaped to interlock with the rod 25 with the valance 20 between the rod 25 and bracket 23 is comprised of a pair of spaced apart arcuate portions 33 and an adjoining channel portion 34. The ends 35 of the arcuate portions 33 angle outwardly to facilitate the engagement of the rod 25 and valance 20 with the bracket 23. The bracket 23 may extend along the length of the headrail 21 or three short brackets 23 may be used as shown in FIG. 1.

The valance 20 is mounted on the headrail 21 in the following manner. The three brackets 23 shown in FIG. 1 are aligned with the upper edge of the headrail 21 and attached with the adhesive strip 24 to the headrail 21. Thereafter, the rod 25 is inserted into the pocket 26 of the valance 20 and the rod 25 is interlocked with the bracket 23 with the valance 20 between the rod 25 and bracket 23 by engaging the spline portion 28 of the rod 25 and valance 20 with the socket portion 32 of the bracket 23. During the interlocking, the valance 20 forms around the spline 28 as the arcuate half portions 29 of the spline 28 flex inwardly to engage the socket portion 32 of the bracket 23.

Figure 5:
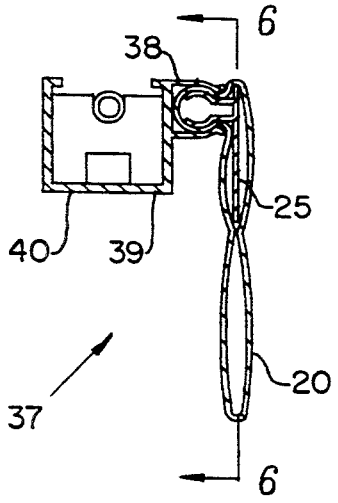
FIG. 5 is a cross-sectional view of an alternate embodiment, taken in the same manner as FIG. 2, wherein one of the mounting members of my invention is made from the same piece as one of the parts of the headrail.
Figure 6:
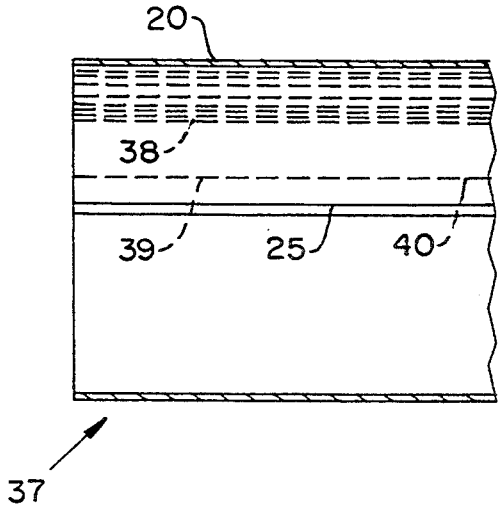
FIG. 6 is a cross-sectional view taken on the line 6—6 in FIG. 5.
Figure 7:
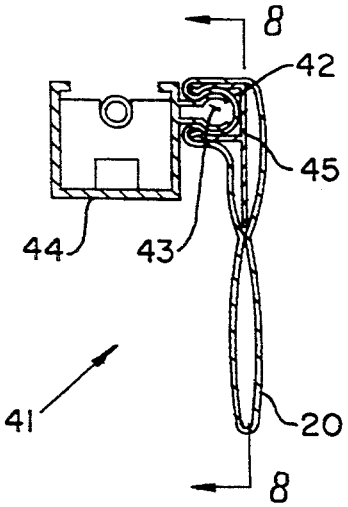
FIG. 7 is a cross-sectional view of an alternate embodiment with a reversal of elements, taken in the same manner as FIG. 2.
Figure 8:
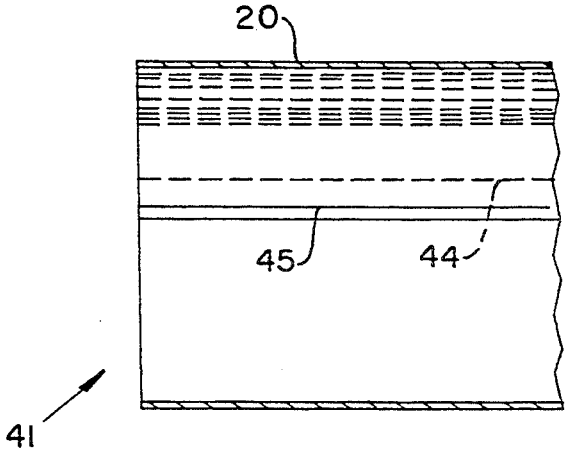
FIG. 8 is a cross-sectional view taken on the line 8—8 in FIG. 7.

In FIGS. 5 and 6, I have shown an embodiment 37 wherein the bracket 38 is formed by extrusion from the same piece as the headrail's track 39. In this embodiment the bracket 38 extends along the length of the headrail 40. In FIGS. 6 and 7, I have shown an embodiment 41 having the interlocking socket 42 and spline 43 portions of the mounting members 44, 45 reversed, i.e., the spline 43 is formed from the same piece as the track 44 and the socket 42 is a portion of the rod 45.

Figure 10:
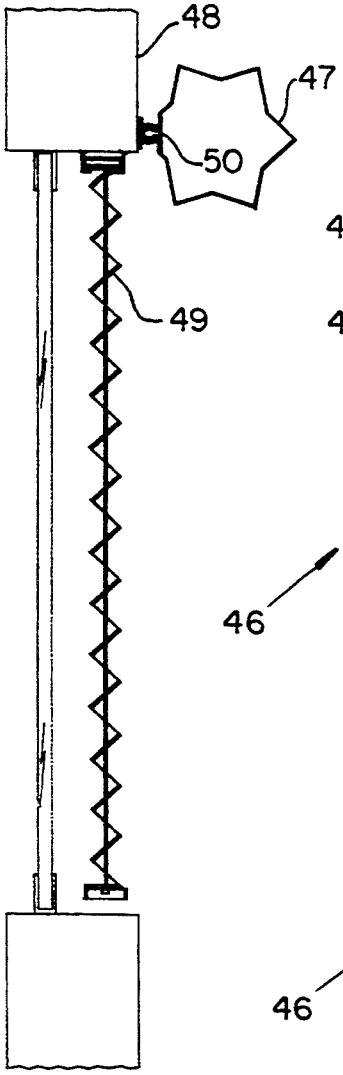
FIG. 10 is a cross-sectional view taken on the line 10—10 in FIG. 9.
Figure 9:
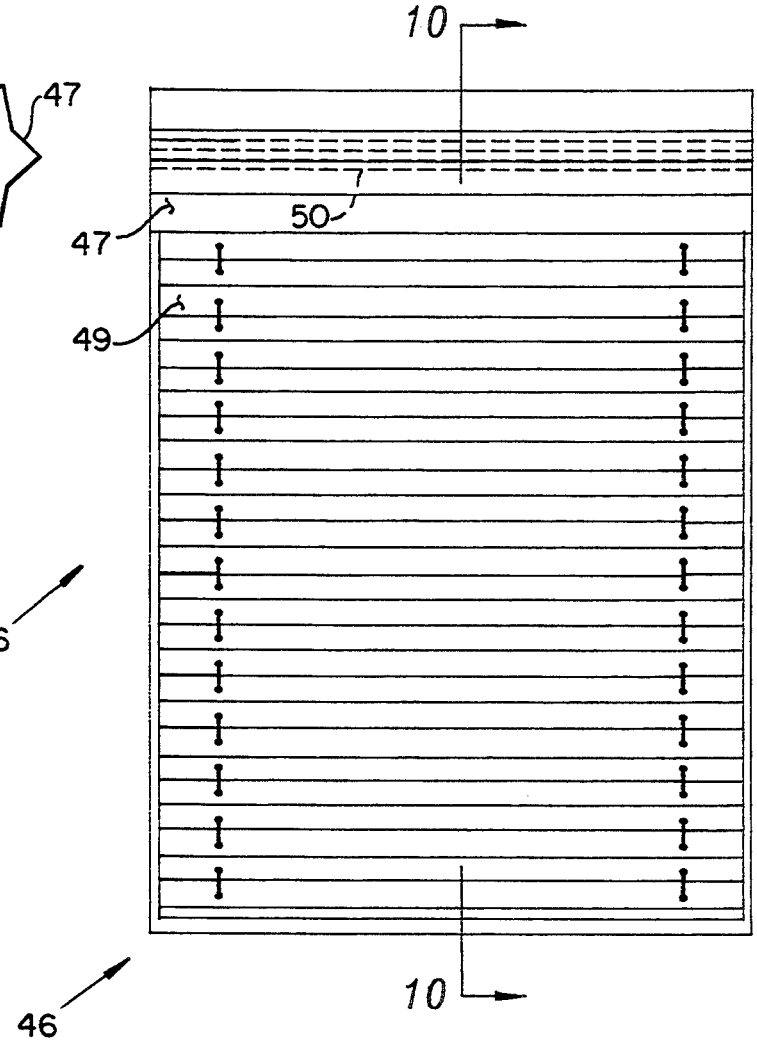
FIG. 9 is a front view of a valance mounted on the headrail of a pleated shade with my invention.
Figure 11:
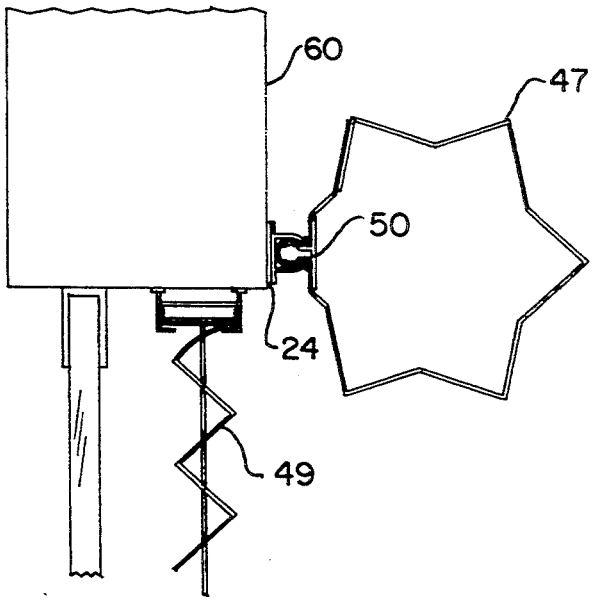
FIG. 11 is an enlarged fragmentary portion of FIG. 10.

In FIGS. 9 through 11, I have shown an embodiment 46 wherein a valance 47 is mounted on a wall 48 above a pair of pleated shades 49, according to my invention. The valance 47 is formed from the same material as the pleated shades 49 by forming the material into a cylinder and the rod 50 is extended through the cylinder.

Figure 13:
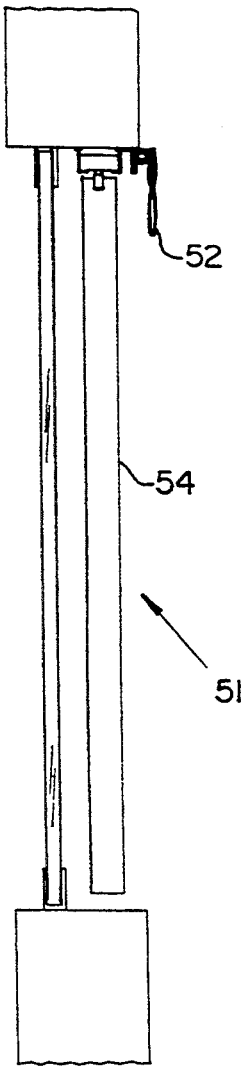
FIG. 13 is a cross-sectional view taken on the line 13—13 in FIG. 12.
Figure 12:
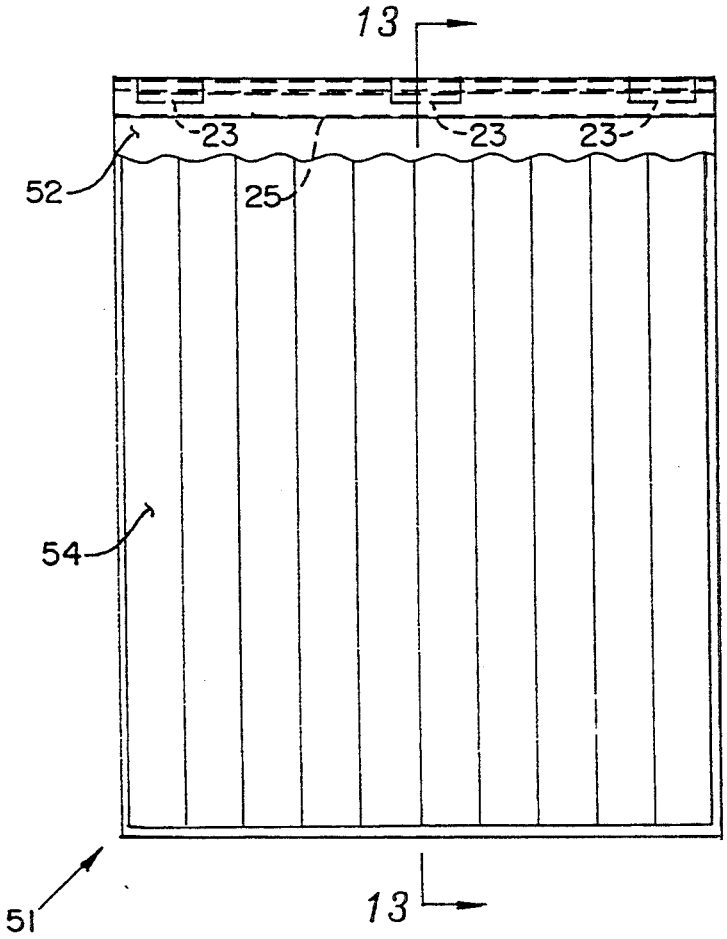
FIG. 12 is a front view of a valance mounted on the headrail of a vertical blind with my invention.
Figure 14:
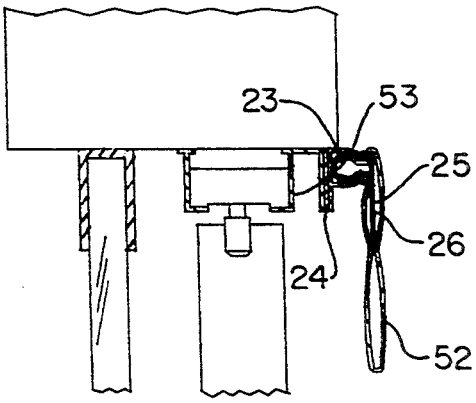
FIG. 14 is an enlarged fragmentary portion of FIG. 13.
Figure 17:
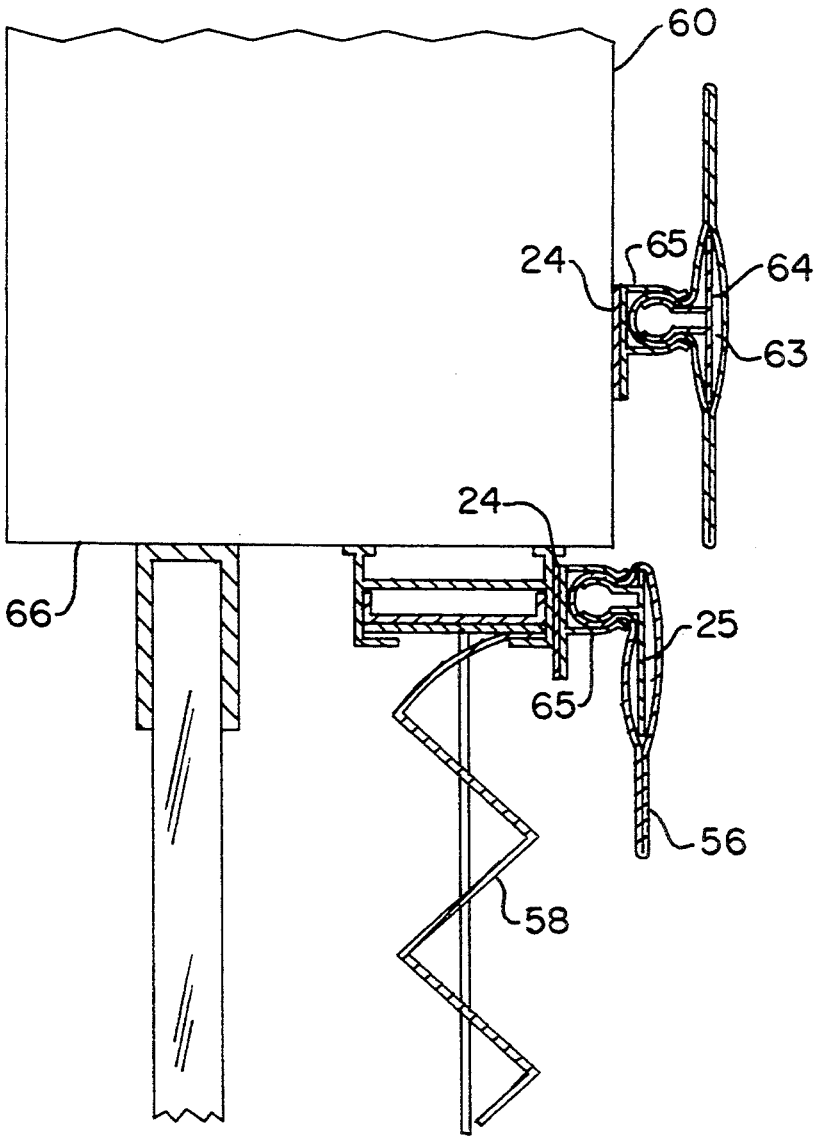
FIG. 17 is an enlarged fragmentary portion of FIG. 16.

As further examples of the wide application of my invention, I have shown an embodiment 51 in FIGS. 12 through 14 wherein a valance 52 is mounted to the headrail 53 of a pair of vertical blinds 54 and in FIGS. 15 through 17 I have shown both a valance 56 mounted to the headrail 57 of a pleated shade 58 and a lambrequin 59 mounted to a wall 60 surrounding the pleated shade 58, according to my invention.

With reference to FIG. 15, the lambrequin 59 is divided into of a pair of horizontal sections 61 and a pair of vertical sections 62. Each of the lambrequin sections 61, 62 has a central pocket 63 which receives the rod 64. Brackets 65 are adhesively attached to the wall portions 60 which surround the window opening 66 and the brackets 65 interlock with the rods 64 and the lambrequin sections 61, 62.

From the foregoing, it will be appreciated that my invention provides an easy to use mounting system and method for applying a variety of decorative window treatments to window blinds and shades which can be used by an ordinary purchaser. Moreover, my system and method does not require nails or screws and substantially reduces the time for mounting window treatments.

Although but several embodiments of my invention have been illustrated and described, it is not my intention to limit the scope of my invention to these embodiments since other embodiments can be derived without departing from the spirit thereof.

I claim:

1. In combination with a decorative window treatment such as a valance or a lambrequin, a mounting system for installing said decorative window treatment in the interior of a building comprising: a pair of mounting members, one of said mounting members comprising an elongated rod member, said rod member having a thin vertical blade portion and an adjoining outward projecting resilient spline portion extending along substantially the length of said blade portion, said spline portion having thin upper and lower spaced apart arcuate portions separated by a gap for deflecting said arcuate portions towards each other during the interlocking of said rod member with the other of said mounting members during the installing of said window treatment; and the other of said mounting members comprising an elongated bracket member engaging in interlocking relationship said spline portion of said rod member with said window treatment between said rod member and said bracket member, said bracket member having a blade portion and a resilient socket portion extending along the length of said blade portion for interlocking with said spline portion of said rod member.

2. The combination as recited in claim 1 wherein said rod member has a resilient channel portion adjoining said arcuate portions for further deflecting said arcuate portions of said spline portion towards each other during the interlocking of said rod member with bracket member during the installing of said window treatment, said channel portion having thin upper and lower spaced apart horizontal portions adjoining said upper and lower arcuate portions of said spline portion of said rod member.

3. The combination as recited in claim 1 further comprising a means for adhesively attaching said rod member to a headrail of a window covering or to a wall.

4. The combination as recited in claim 1 further comprising a means for adhesively attaching said bracket member to a headrail of a window covering or to a wall.

5. The combination as recited in claim 1 wherein said rod member is a portion of a track of a head rail, said rod member being formed from the same piece as said track of said headrail.

6. The combination as recited in claim 1 wherein said bracket member is a portion of a track of a head rail, said bracket member being formed from the same piece as said track of said headrail.

7. The combination as recited in claim 1 wherein said socket portion of said bracket member has end portions which flare outwardly to receive in interlocking relationship said spline of said first member and said window treatment.

8. The combination as recited in claim 1 wherein said decorative window treatment is a valance.

9. The combination as recited in claim 1 wherein said decorative window treatment is a lambrequin.

10. In combination with a decorative window treatment and a window covering such as a blind or a shade, a mounting system for installing said decorative window treatment comprising: window covering having a headrail for installing said window covering, said head rail having an elongated resilient window treatment mounting portion extending along the length of said headrail, said mounting member formed from the same piece as a track portion of said head rail and having thin resilient upper and lower spaced apart portions separated by a gap; and a resilient window treatment mounting member which is adapted to interlock with said resilient mounting portion of said headrail with said window treatment between said headrail's resilient mounting and said resilient mounting member, said headrail's resilient mounting portion and said resilient mounting member having thin resilient upper and lower spaced apart portions separated by gaps.

11. A method for mounting a window treatment in the interior of a building, comprising the steps of: attaching a first resilient mounting member to a headrail of a window covering attached to the interior of a building, installing a second resilient mounting member into a pocket of a window treatment; and interlocking said first and second resilient mounting members with said window treatment between said first and said second mounting members.

12. The method as recited in claim 11 wherein said first resilient mounting member is adhesively attached to said headrail.

* * * * *